United States Patent [19]

Wessel et al.

[11] Patent Number: 4,606,267

[45] Date of Patent: Aug. 19, 1986

[54] ELECTROTHERMAL PAGE PRINTER

[75] Inventors: Gerhard Wessel, Stuttgart; Heinz Ebner, Ditzingen, both of Fed. Rep. of Germany

[73] Assignee: International Standard Electric Corporation, New York, N.Y.

[21] Appl. No.: 670,778

[22] Filed: Nov. 13, 1984

[51] Int. Cl.[4] ..... B41J 3/02

[52] U.S. Cl. ..... 101/93.04; 400/120; 346/76 PH; 219/216

[58] Field of Search ..... 400/120, 121; 101/93.04; 219/216 PH; 346/76 PH

[56] References Cited

U.S. PATENT DOCUMENTS

| | | | |
|---|---|---|---|
| 3,340,381 | 9/1967 | Best | 346/76 PH |
| 3,862,394 | 1/1975 | Lane, III | 346/76 PH |
| 4,067,017 | 1/1978 | Dertouzos et al. | 346/76 PH |
| 4,151,397 | 4/1979 | Boor, Jr. et al. | 346/76 PH |
| 4,242,565 | 12/1980 | Schoon | 346/76 PH |
| 4,423,425 | 12/1983 | Reese et al. | 346/76 PH |
| 4,492,482 | 1/1985 | Eguchi et al. | 400/120 |

FOREIGN PATENT DOCUMENTS

| | | | |
|---|---|---|---|
| 0118273 | 7/1983 | Japan | 219/216 PH |
| 0035956 | 2/1984 | Japan | 346/76 PH |
| 0647531 | 2/1979 | U.S.S.R. | 219/216 PH |

OTHER PUBLICATIONS

IBM Technical Disclosure Bulletin, "Print Head Adjustment" by Castle, vol. 26, No. 2, Jul. '83, p. 733.

IBM Technical Disclosure Bulletin, "Electrolytic Print Head" by Pigos et al., vol. 27, No. 6, Nov. '84 (filed 10-31-84), pp. 3226-3227.

*Primary Examiner*—Edgar S. Burr
*Assistant Examiner*—John A. Weresh
*Attorney, Agent, or Firm*—John T. O'Halloran; Thomas F. Meagher

[57] ABSTRACT

This invention relates to a page printer having an electro-thermal dot-matrix printing mechanism. The latter comprises at least one print plate which is disposed parallel in relation to the print line and radially in relation to the platen, which is hooked at both ends into a tensioning device. The print plate consists of a carrier plate made of material having relatively good electrical and heat-conducting properties. It is applied with its front surface to the thermo-sensitive recording medium on which recordings are made via a plurality of closely adjacent heating elements. These heating elements are deposited onto at least one of the lateral faces of the carrier plate, made flush with the front surface, and are conductively connected to the carrier plate. The remaining part of each of the lateral faces is covered, throughout the widths of the heating elements, with a layer of insulating material on which the conducting paths extending to the heating elements are disposed. The carrier plate serves as the common electric return conductor. On the carrier plate, a number of integrated circuits are disposed which, with their outputs, are connected to the conducting paths extending to the heating elements. These integrated circuits serve to convert the control instructions for the heating elements, as applied via terminals on the rearward longitudinal edge of the carrier plate.

21 Claims, 11 Drawing Figures

ELECTROTHERMAL PAGE PRINTER

The present invention relates to a page printer of the type having an electronic dot-matrix printing mechanism comprising at least one print plate aligned vertically in relation to the recording medium, which consists of a carrier plate having a plurality of closely spaced heating elements which are connected to individual conducting paths disposed on the carrier plate.

A page printer of the aforementioned type is known from the German Published Patent Application No. DE-AS 12 43 432. Its printing mechanism comprises a bearing member for guiding the recording medium in the printing plane. Vertically and perpendicularly in relation to the bearing member there is disposed a plurality of densely packed print plates which are insulated from one another, and which each consist of a carrier plate of an electrically non-conductive but highly heat-dissipating material, equipped with electro-thermal heating elements. On the front side of the carrier plate facing the bearing member, several heating elements are deposited one above the other which, via conducting paths, are connected to at least one lateral face.

This printing mechanism only permits the representation of relatively coarsely rastered characters and images. In the horizontal direction, this is due to the carrier plates which are insulated from one another, and in the vertical direction, this is due to the heating elements disposed at a spaced relation. The plurality of heating elements to be controlled involves a considerable investment in control circuits. Since the heating elements are disposed on the front surfaces of the carrier plates, they are subjected to an increased wear caused by their being applied to the recording medium. Therefore, they have to be provided with a protective layer preventing the heating elements from coming into a direct contact with the recording medium. Relative to the layer thickness, this requires more heating power and may lead to blurred contours of the matrix, or image, dots. The vertical arrangement of the printing plates assembled to form one block obstructs the view onto some of the previously printed lines.

It is an object of the invention to provide an electrothermal printing mechanism which, by having a simple construction, safeguards an optimum image-dot density.

This object is achieved by the invention and the advantageous embodiments of the subject matter of the invention. One or two print plates disposed along the print line are provided. Heating elements are attached laterally from the front surface to the carrier plate. The nitrated, or nitrified, front surface substantially absorbs the applicational pressure to the recording medium, so that the heating elements are not in need of a layer which protects against wear, and can be directly applied to the recording medium. The heating elements are connected directly in a conductive manner to the carrier plate. This carrier plate serves as a common return conductor and, at the same time, as a heat abstractor. The small vertical extension of one platen permits an arrangement in a page printer which allows a direct viewing of the recording which is being made, throughout the entire print line width.

In the following description, the invention will be explained in greater detail with reference to four examples of embodiments shown in FIGS. 1 to 7 of the accompanying drawings, in which.

Figure 4:
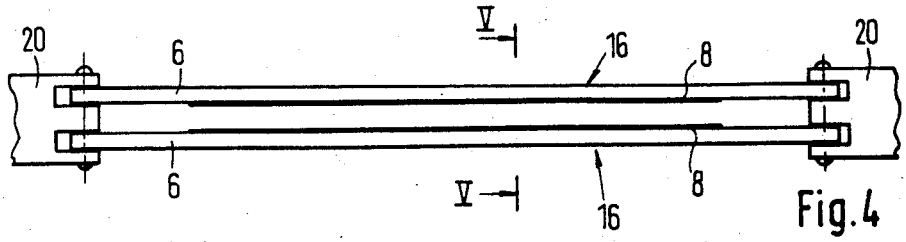
Figure 3B:
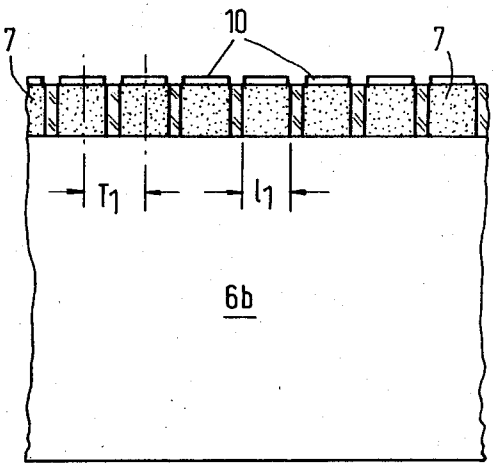
Figure 3A:
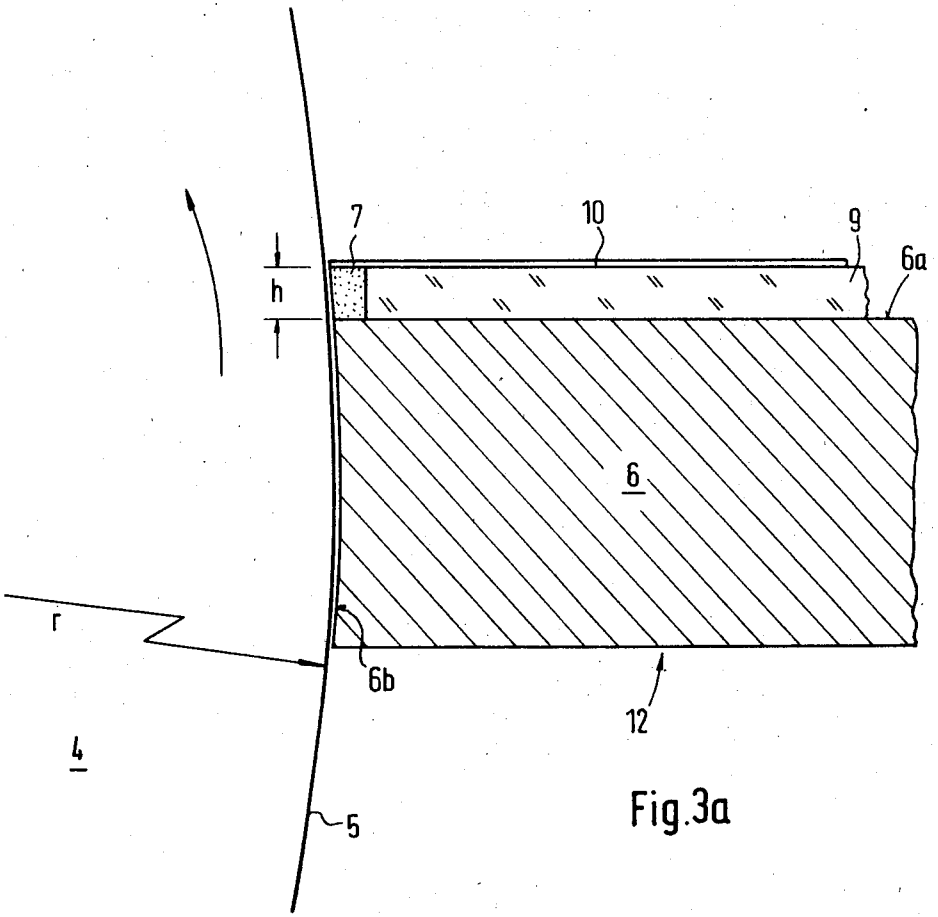
Figure 5B:
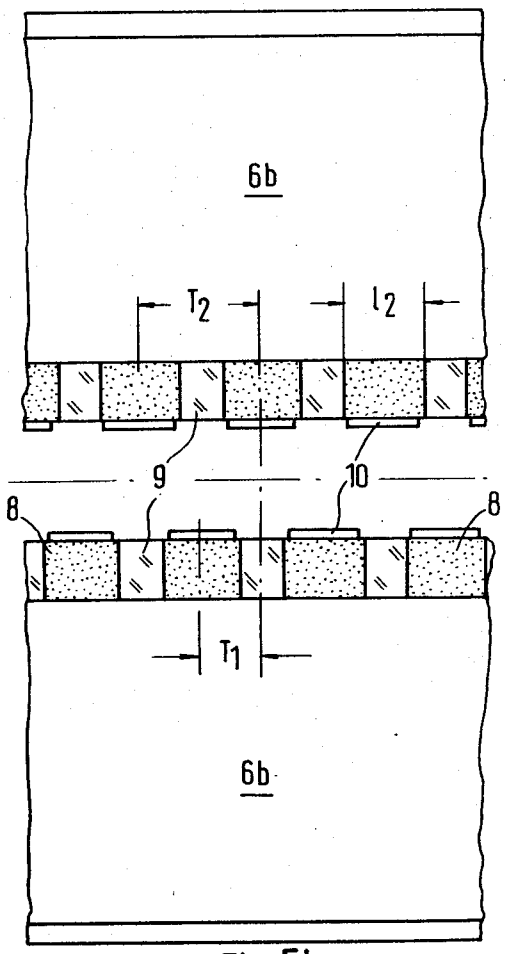
Figure 5A:
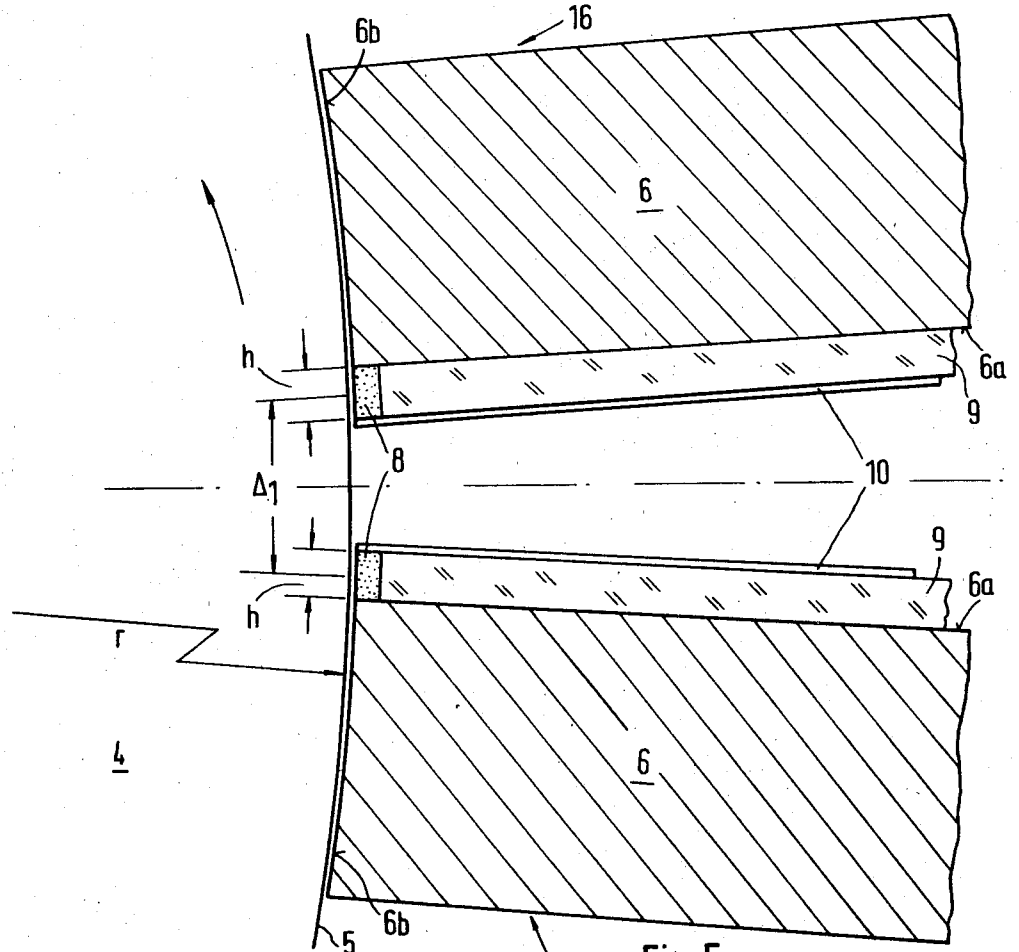
Figure 6B:
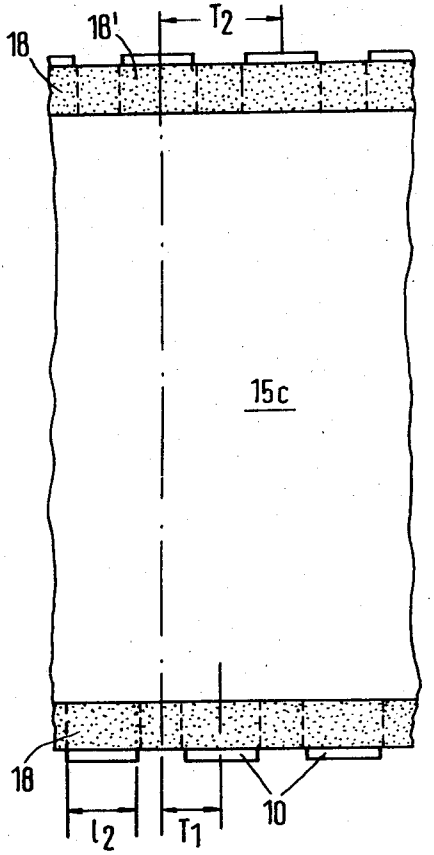
Figure 6A:
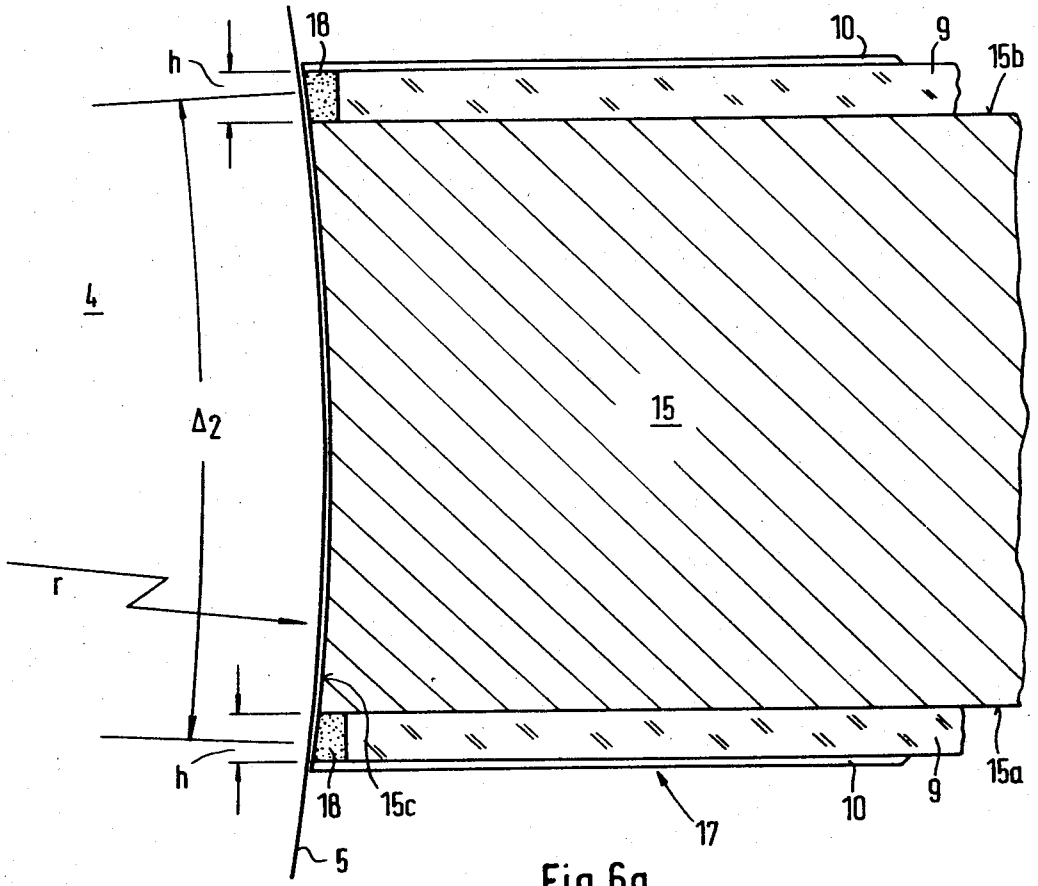
Figures 7A, 7B:
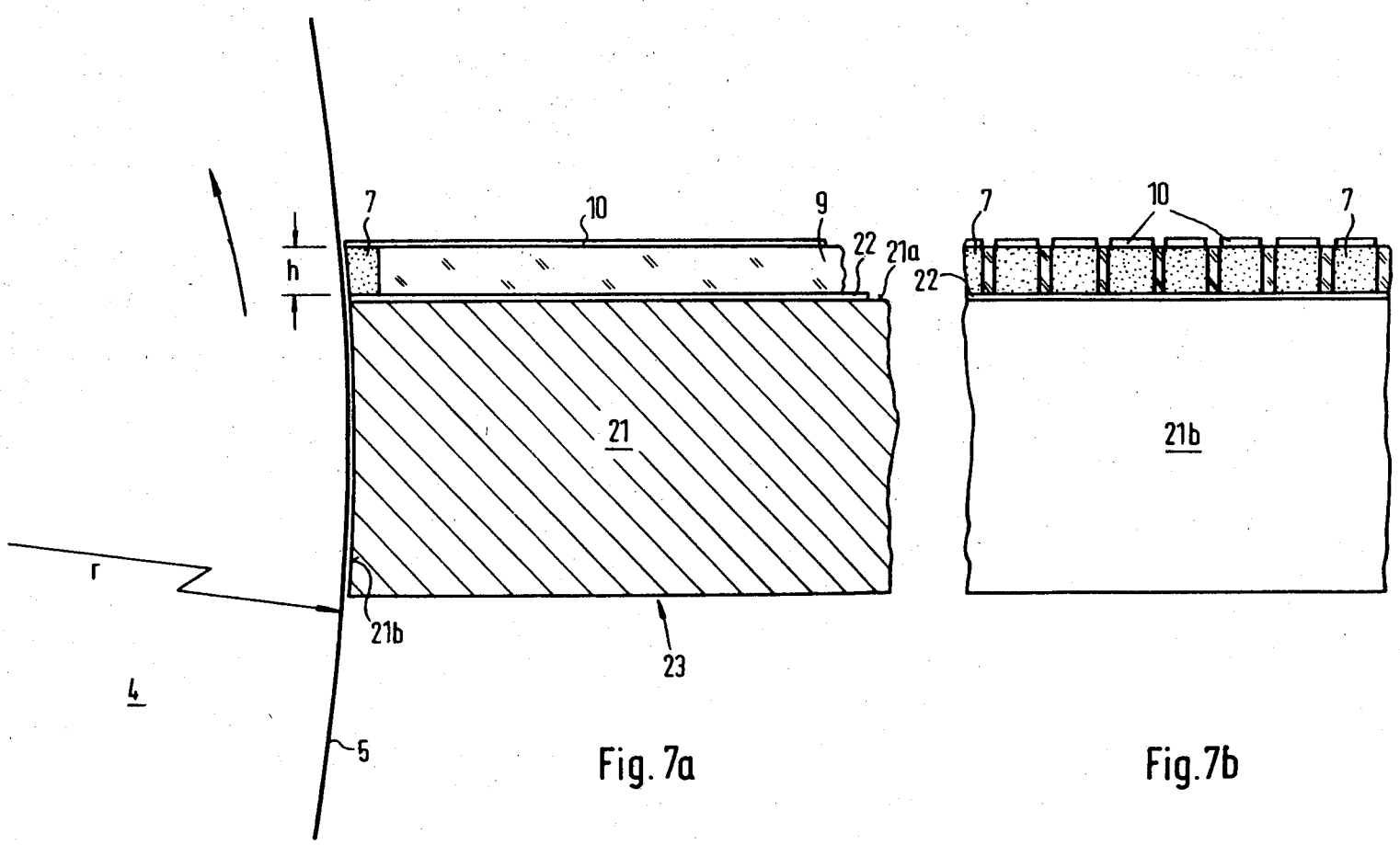

FIG. 3*a* is a first embodiment of a print plate of the invention. It shows the detail A of FIG. 1 in a sectional view and on a considerably enlarged scale;

FIG. 3*b* shows one detail of the print plate of FIG. 3*a*, with a view onto the front surface;

FIG. 4 out of scale, is the top view of a second embodiment employing two print plates according to the invention;

FIG. 5*a* shows the arrangement according to FIG. 4 in a section taken on line V—V of FIG. 4, in a partial representation and on a considerably enlarged scale;

FIG. 5*b* shows one detail of the print plates of FIG. 4, with a view on to the front surfaces;

FIG. 6*a* shows a third embodiment of a print plate according to the invention in a sectional and partial representation and which, on both sides, is shown to have continuous resistance paths serving as the heating elements, likewise on a considerably enlarged scale;

FIG. 6*b* shows one detail of the print plate of FIG. 6*a*, with a view on to the front surface;

FIG. 7*a* is a fourth embodiment of a print plate according to the invention in a sectional and partial representation, comprising a carrier plate of insulating material provided with a conductive coating on one side; and FIG. 7*b* shows one detail of the print plate of FIG. 7*a*, with a view on to the front surface.

Figure 1:
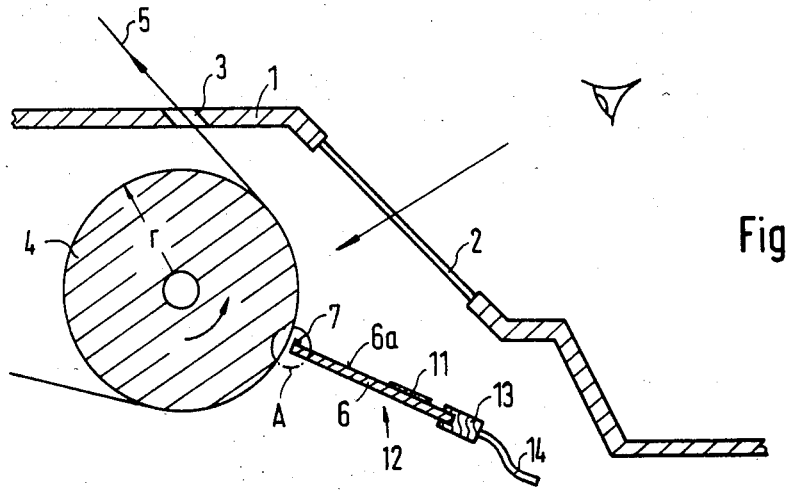
FIG. 1 is the schematic, sectional representation of an electrothermal dot-matrix printing mechanism according to the invention, taken on line I—I of FIG. 2, forming part of a page printer denoted by the housing members.
Figure 2:
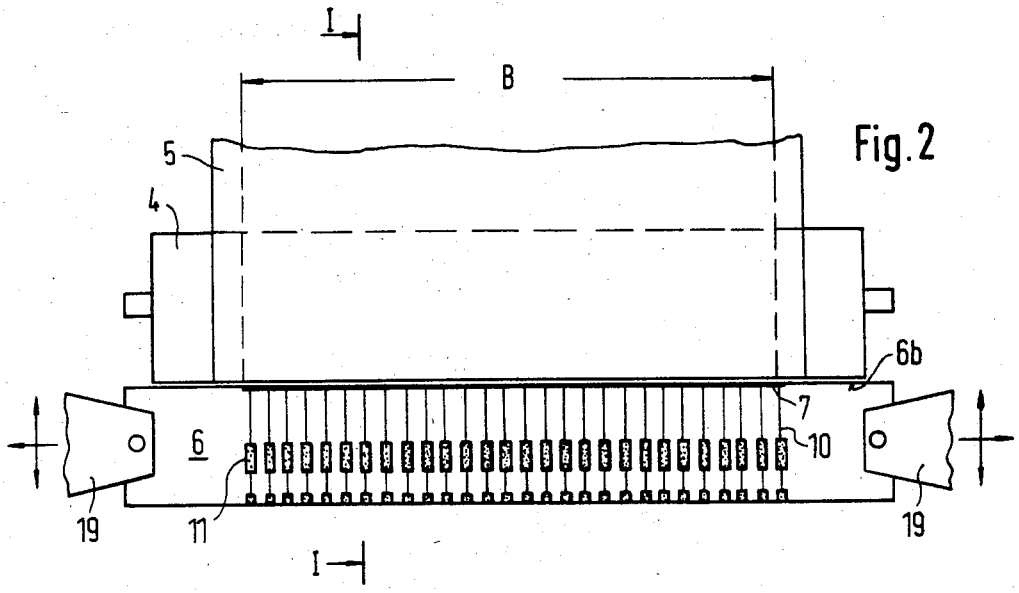
FIG. 2 is an out-of-scale representation of the dot-matrix printing mechanism as shown in FIG. 1, in a top view.

As can be seen from FIGS. 1 and 2, a plate of glass 2 is let into the hood 1, for permitting the viewing of the printed part on a thermosensitive recording medium 5. The latter is applied to a platen 4 having the radius r, by which the recording medium 5 is transported in the direction as indicated by the arrow. Through a slot 3, it is led out of the housing of the page printer. Below the glass window 2 and radially in relation to the platen 4, there is disposed a print plate 12 extending along the print line. This plate has a supporting element, a carrier plate 6 which, with its one front surface 6*b*, is applied with a slight spring pressure throughout its entire length to the recording medium led around the platen 4. On at least one lateral face 6*a* of the carrier plate 6, heating elements 7 are disposed flush with the front surface 6*b*, as shown in FIG. 3*a*. These heating elements, via conducting paths 10, are in connection with integrated circuits 11 on the carrier plate 6. These integrated circuits 11 serve to convert the control instructions for the heating elements 7. The control instructions are applied from a central control unit, not shown, via lead-in conductors 14 and via connectors 13 disposed on the rearward longitudinal edge of the carrier plate 6, to the integrated circuits 11.

As can be recognized from the top view in FIG. 2, the carrier plate 6, throughout the print field width B, and along the front surface 6*b* as applied to the recording medium 5, is provided with a plurality of closely spaced heating elements 7. The corresponding large number of connections to the integrated circuits 11 is symbolically represented by the conducting paths 10. The carrier plate 6 is on both sides longer than the print field width B. With its longitudinal ends, the carrier plate 6 is suspended in a clamping or tensioning device 19 which is adjustable transversely in relation to the clamping direction in the plane of the carrier plate 6. The transverse adjustment serves to readjust the spring force with which the carrier plate 6 is applied with its front side to the recording medium 5.

FIG. 3a, on a considerably enlarged scale, shows the detail A of FIG. 1 as a first embodiment of a print plate 12, whereas FIG. 3b shows part of the plate 12 with a view on to the front surface 6b of the carrier plate 6 as applied to the recording medium 5. The carrier plate 6 is made of a material, such as steel, which has relatively good electrical and heat-conducting properties. Flush with the front surface 6b, closely spaced heating elements 7 are disposed in the longitudinal direction of the lateral face 6a, which are connected to the carrier plate 6 in an electrically conducting manner. The remaining part of the lateral face 6a, including the interspaces between the heating elements 7, is coated with a glaze 9 whose thickness is equal to the height h of the heating elements. Onto this insulating layer, the conducting paths 10 are deposited at a spacing corresponding to that of the heating elements 7, and are conductively connected to the other ends of the heating elements 7. The front surface 6b, including the heating elements 7 attached to the other lateral face 6a, is concavely arched transversely in relation to the longitudinal extension of the carrier plate 6 so as to equal the radius of curvature r of the platen 4, and to safeguard an application throughout the entire width of the front surface 6b. In order to increase the resistance to wear, the front surface 6b is nitrated, or nitrified, in the manner known per se. In the case of a square dot-matrix surface area, the length $l_1$ of the heating elements 7 is equal to the height h at a division $T_1$ which corresponds to the dot-matrix spacing during recording.

Recordings on the recording medium 5 are made in a raster-linewise manner throughout the entire print field width B during a continuous rotational movement of the platen 4.

Owing to the spaced arrangement of the heating elements 7, a continuous print image in the longitudinal direction of the print field cannot be achieved with this first embodiment, but can be achieved with a second embodiment as shown in FIGS. 4, 5a, and 5b.

FIG. 4, in a schematic representation, shows two print plates 16 disposed mirror-invertedly in relation to one another, in a top view, which are hooked into a correspondingly designed tensioning device 20. FIG. 5a, on a considerably enlarged scale, shows the arrangement in a section taken on line V—V of FIG. 4, and in a partial representation, whereas FIG. 5b shows one detail of the print plates 16 with a view on to the front surfaces 6b of the carrier plates 6 as applied to the recording medium 5. The print plates 16, with the exception of the length $l_2$ and the divisional spacing $T_2$ of the heating elements, are identical with the print plates 12 shown in FIG. 3a. Owing to the radius of curvature r of the platen 4, the two plates 16 are disposed at a small angle in relation to one another, with the lateral surfaces 6a, of the carrier plates 6 on which the heating elements 8 are disposed, facing one another. As can be recognized from FIG. 5b, the heating elements 8 are disposed at a divisional spacing $T_2$ which is equal to double the dot-matrix spacing $T_1$. The rows of heating elements of the two plates 16 are staggered with respect to one another by the divisional spacing $T_1$, so that the heating elements 8 of the two rows are positioned so as to fill gaps. The heating elements 8 have a length $l_2$. This length is so dimensioned that the spacing between the individual heating elements 8 is somewhat smaller than the length $l_2$ of the individual heating elements 8. By taking this measure it is possible, during a recording, to obtain a closed continuous print image also in the longitudinal direction of the print lines, in that each raster line is recorded in two phases. At a rotation of the platen 4 in the anticlockwise direction, as is indicated by an arrow, the information contents of each individual raster line, to the one half, is recorded on the recording medium 5 in an interrupted line via the print plate 16 disposed on the left in FIG. 5a, whereas the completion of the respective raster line is completed via the right-hand print plate 16 following a corresponding advance of the recording medium 5 about the angular path $\Delta_1$. According to the length $l_2$ of the heating elements 8, the image points recorded next to each other at the divisional spacing $T_1$ slightly overlap each other, so that also in the horizontal direction there is safeguarded a closed or continuous print image.

FIG. 6a likewise on a considerably enlarged scale, shows a third embodiment of a print plate 17 in a cross sectional and partial representation, while FIG. 6b shows one detail of the plate 17 with a view on to the front surface 15c of the associated carrier plate 15, as applied to the recording medium 5. The carrier plate 15, just like the print plates 12 and 16 as described hereinbefore, is likewise made of a material which has relatively good electrical and heat-conducting properties, with this carrier plate 15, however, being almost double as thick as the aforementioned ones. On both lateral faces 15a and 15b, continuous resistance paths 18 of a height h are disposed, which are flush with the front surface 15c and in an electrically conducting connection with the carrier plate 15. The resistance paths 18, in accordance with the examples of embodiments described hereinbefore, are followed by the glaze 9 in the height of the resistance paths 18. Onto this insulating layer, the conducting paths 10 are deposited which, at the upper ends, are conductively connected to the respective resistance path 18. At least within the contact area of the respective resistance path 18, the conducting paths 10 have a width which almost equals the desired length $l_2$ of the dot-matrix surface, and which are determinative of the heating areas 18'. Considering that the current always takes the way of the lowest resistance, there is practically only effected a heating up of the resistance path 18 in the areas 18' corresponding to the widths of the conducting paths 10. This is of practical importance above all in cases where a high resolution, that is, a very large number of image points per surface unit is required, which calls for a correspondingly large number of closely adjacent heating elements.

For the same reasons as explained hereinbefore in connection with the second embodiment, the conducting paths 10 are disposed at a divisional spacing $T_2$, and the conducting paths 10 on the one side are staggered with respect to those on the other side by the divisional spacing $T_1$. Accordingly, the heating areas 18' of the opposite resistance paths 18, which are determined by the widths of the conducting paths 10, are thus disposed in relation to one another so as to fill gaps. Also in this case, the recording of each raster line is carried out in two phases in that, for example, the even-numbered raster line image points, via the heating areas 18', are recorded on the lower side of the carrier plate 15, whereas the respective raster line is completed by the odd-numbered image points following an advancement of the recording medium 5 by the angular path $\Delta_2$ via the heating areas 18' on the other lateral face 15*b* of the carrier plate 15.

FIG. 7*a*, again on a considerably enlarged scale, shows the fourth embodiment of a print plate 23 in both a cross sectional and partial representation, with FIG. 7*b* showing one detail of the plate 23 with a view on to the front surface 21*b* of the associated carrier plate 21 as applied to the recording medium 5. Unlike in the previously described examples of embodiments, the carrier plate 21 is made of an insulating material of high thermal conductivity, such as a ceramic material. According to the one-sided arrangement of the heating elements 7, as chosen by way of example, the entire upper lateral face 21*a* of the carrier plate 21 is electrically conductive, for example, by way of a copper layer 22 plated or vaporized thereon. Onto this, the heating elements 7 are disposed in a conductive connection with the copper layer 22, and made flush with the front surface 21*b*. The copper layer 22 is the common electrical return conductor for the heating elements 7 and, owing to its areal embodiment, and jointly with the carrier plate 21, serves as an abstractor for the heating produced during the operation of the printing mechanism. The construction of the printing plate 21 may correspond to that of the print plate 12 as shown in FIGS. 3*a* and 3*b*. In this case, too, the individual heating elements 7 may be replaced by a resistance path 18 as shown in FIGS. 6*a* or 6*b* whenever a separate arrangement of the heating elements appears to be not advantageous for production or technical reasons.

While the present invention has been described in connection with preferred embodiments thereof, it is to be understood that additional embodiments, modifications, and applications which will become obvious to those skilled in the art are included within the spirit and scope of the invention as set forth by the claims appended hereto.

We claim:

1. A page printer with an electronic dot-matrix printing mechanism having a platen adapted for transporting a recording medium at least one print plate disposed along a print line of said platen, comprising:

at least one carrier plate having a front surface to be applied to the recording medium when in an operative position, and at least one lateral face adjacent said front surface, said front surface having a coating thereon, said coating being hard with respect to said carrier plate to provide a wear resistant surface, a plurality of closely spaced heating elements, disposed on said lateral face of said carrier plate and flush with said front surface of said carrier plate, said heating elements being in direct contact with said recording medium when said carrier plate is in said operative position, and individual conducting paths, connected to said heating elements, to provide control instructions to said heating elements.

2. A page printer as claimed in claim 1, wherein said carrier plate consists of an electrically conductive material.

3. A page printer as claimed in claim 2, wherein said carrier plate is heat conductive.

4. A page printer as claimed in claim 2, wherein said heating elements are connected to said carrier plate and to said conducting paths.

5. A page printer as claimed in claim 1, wherein said carrier plate consists of an insulating material and has an electrically conductive lateral face.

6. A page printer as claimed in claim 5, wherein said carrier plate is heat conductive.

7. A page printer as claimed in claim 5, wherein said heating elements are connected to said electrically conductive lateral face and to said conducting paths.

8. A page printer as claimed in claim 1, further comprising:

an insulating layer, disposed on said carrier plate surface, except for a portion of said surface on which said heating elements are disposed, having a thickness equal to the height of said heating elements, and on which said conducting paths extending to said heating elements are disposed.

9. A page printer as claimed in claim 1, wherein a front surface of said carrier plate, including said adjacent heating elements, is concavely equal to the curvature of said platen.

10. A page printer as claimed in claim 7, wherein said front surface of said carrier plate is nitrated or nitrified.

11. A page printer as claimed in claim 1, wherein said carrier plate is longer than a print field width and is retained between horizontally acting clamping means.

12. A page printer as claimed in claim 11, wherein said clamping means are adjustable in the plane of said carrier plate as well as vertically in relation thereto.

13. A page printer as claimed in claim 1, wherein two print plates are disposed at a spaced relation.

14. A page printer as claimed in claim 13, wherein the divisional spacing of said heating elements corresponds to double the dot-matrix spacing of said electronic dot-matrix printing mechanism.

15. A page printer as claimed in claim 14, wherein the length of said heating elements is somewhat greater than the spacing between them.

16. A page printer as claimed in 15, wherein said heating elements of said two carrier plates are staggered in relation to one another by a division.

17. A page printer as claimed in claim 1, wherein there are two lateral faces, and said heating elements are disposed flush with the front surface of said carrier plate, and are disposed on both said lateral faces of said carrier plate.

18. A page printer as claimed in claim 17, wherein the divisional spacing of said heating elements corresponds to double the dot-matrix spacing.

19. A page printer as claimed in claim 18, wherein the length of said heating elements is greater than the spacing between them.

20. A page printer as claimed in claim 19, wherein said heating elements on both lateral faces are staggered in relation to one another by a division.

21. A page printer as claimed in claim 1, wherein a continuous heating resistance path is provided which is connected to said conducting paths, and wherein said conducting paths having a width corresponding to a length of a respective heating area.

* * * * *